US005586451A

United States Patent [19]

Koeberle et al.

[11] Patent Number: 5,586,451

[45] Date of Patent: Dec. 24, 1996

[54] PROCESS AND INSTALLATION FOR THE PRODUCTION OF OXYGEN BY DISTILLATION OF AIR

[75] Inventors: Yves Koeberle, Le Perreux sur Marne; Philippe Fraysse, Fontenay aux Roses, both of France

[73] Assignee: L'Air Liquide, Societe Anonyme Pour l'Etude et l'Exploitation des Procedes Georges Claude, Paris, France

[21] Appl. No.: 419,441

[22] Filed: Apr. 10, 1995

[30] Foreign Application Priority Data

Apr. 12, 1994 [FR] France ..... 94 04298

[51] Int. Cl.[6] ..... F25J 3/02

[52] U.S. Cl. ..... 62/646; 62/654

[58] Field of Search ..... 62/22, 25, 646, 62/654

[56] References Cited

U.S. PATENT DOCUMENTS

| | | | |
|---|---|---|---|
| 3,214,925 | 11/1965 | Becker . | |
| 4,994,098 | 2/1991 | Agrawal et al. | 62/22 |
| 5,076,823 | 12/1991 | Hansel et al. | 62/24 |
| 5,079,923 | 1/1992 | Grenier | 62/24 |
| 5,228,296 | 7/1993 | Howard . | |

FOREIGN PATENT DOCUMENTS

| | | |
|---|---|---|
| 0454327 | 10/1911 | European Pat. Off. . |
| 0357299 | 3/1990 | European Pat. Off. . |
| 0580348 | 1/1994 | European Pat. Off. . |
| 1253717 | 1/1961 | France . |
| WO88/01037 | 2/1988 | WIPO . |

*Primary Examiner*—Ronald C. Capossela
*Attorney, Agent, or Firm*—Young & Thompson

[57] ABSTRACT

Process and installation for the production of gaseous oxygen under pressure by cryogenic distillation of air in a double column (5) comprising a medium pressure column (6) and a low pressure column (7). Rich liquid from the medium pressure column is divided into first and second liquid fractions which are sent to different levels in the low pressure column (7). These different levels are both below the level of withdrawal of impure nitrogen from the low pressure column (7). A fluid enriched in argon is withdrawn from the low pressure column (7) and distilled in an argon column (16). Liquid enriched in oxygen is withdrawn from a lower portion of the low pressure column (7). The two fractions of rich liquid are cooled to different temperatures before being sent to the low pressure column (7). A portion of the supply air is blown into an intermediate level of the low pressure column (7) and the levels of injection of the rich liquid are not below this intermediate level.

10 Claims, 3 Drawing Sheets

PROCESS AND INSTALLATION FOR THE PRODUCTION OF OXYGEN BY DISTILLATION OF AIR

The present invention relates to a process and an installation for the production of oxygen by distillation of air and more particularly to a process and an installation for the production of oxygen under pressure.

Figure 1:
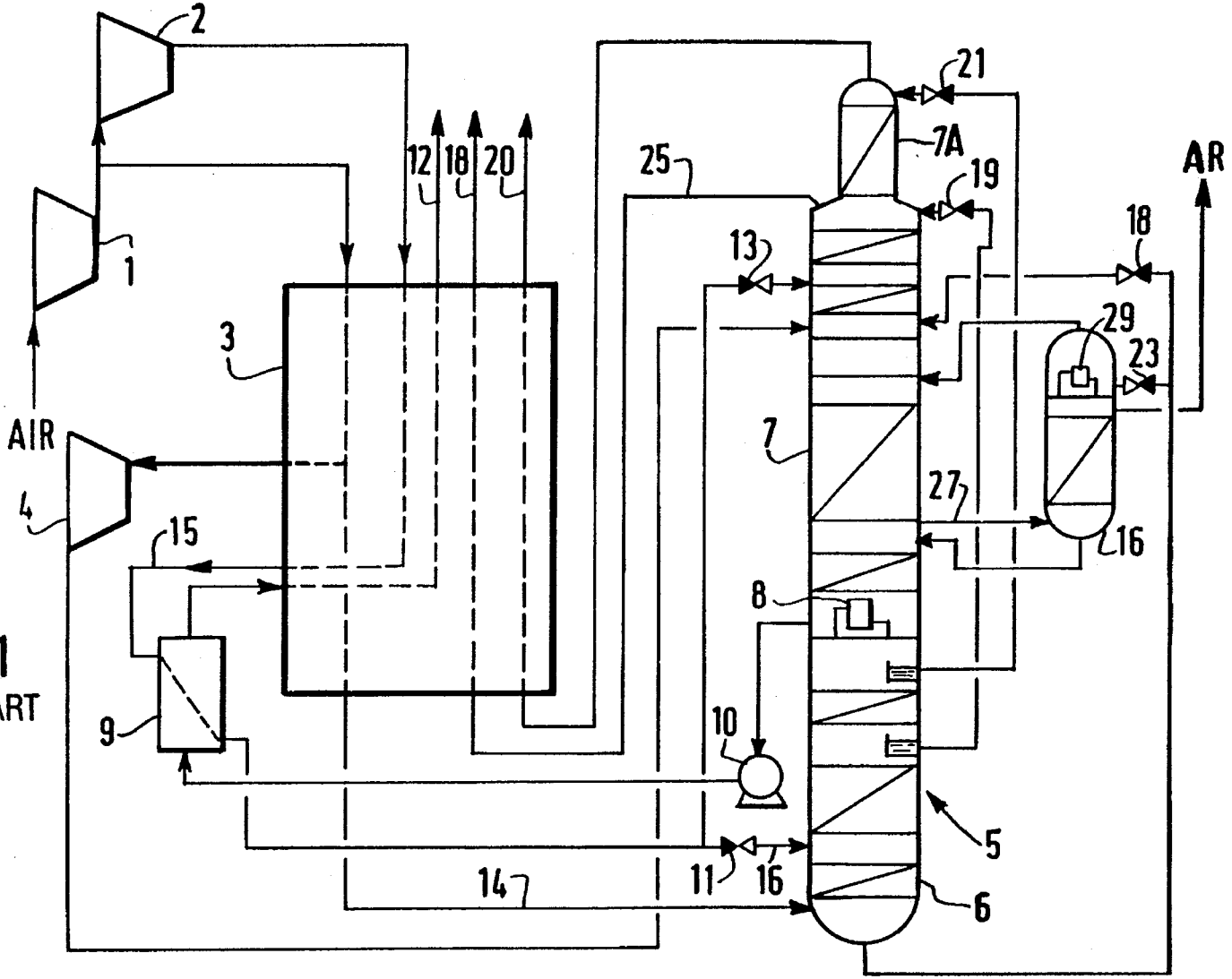
FIG.1 PRIOR ART

EP-A-422.974 discloses a process for the production of oxygen under pressure by cryogenic distillation of air in a double column. Liquid oxygen is withdrawn from the base of the low pressure column 7, as shown in FIG. 1, and is vaporized in the auxiliary exchanger 9 by heat exchange with a fraction of the supply air. The remaining portion of the supply air is divided into two streams, of which one goes directly to the medium pressure column 6, via the conduit 14, and of which the other is expanded in a turbine 4 before being sent to the low pressure column 7.

A first object of this invention is to reduce the costs of energy used by a process for the production of oxygen under pressure relative to those of the known processes.

A second object of this invention is to improve the argon output in the case in which the installation also comprises an argon column supplied by the low pressure column.

To this end, the invention has for its object a process for the production of gaseous oxygen under pressure by cryogenic distillation of air in a double column comprising a medium pressure column and a low pressure column, in which the rich liquid from the medium pressure column is divided into first and second liquid fractions which are sent to different levels in the low pressure column, characterized in that the different levels are below a level of withdrawal of impure nitrogen from the low pressure column.

So as to improve the reflux of the low pressure column, the rich liquid from the medium pressure column is divided into first and second fractions and the first and second fractions are sent to different levels in the low pressure column after preliminary subcooling. This permits particularly improving substantially the argon extraction in the case in which the installation also comprises an argon column.

The two fractions can be sent to the low pressure column at different temperatures, so as further to improve the reflux in the low pressure column and the extraction of argon in the case in which the installation also comprises an argon column.

Preferably, a portion of the supply air is expanded before being sent to the double column, the remaining portion of the supply air being partially condensed in the auxiliary exchanger.

As to the air which condenses only partially in the auxiliary exchanger, the heat exchange with oxygen under pressure takes place at a medium temperature warmer than if it were totally condensed.

For a same temperature difference in the auxiliary exchanger, the pressure of the air can thus be reduced. By utilizing a film vaporizer as auxiliary exchanger, as described in EP-A-130.122, the temperature difference can be reduced to a mean value of 0.6° C.

The invention also has for its object an installation for the production of gaseous oxygen under pressure by cryogenic distillation of air comprising a double column, constituted by at least one medium pressure column surmounted by a low pressure column, means to withdraw impure nitrogen from the low pressure column, and means to withdraw rich liquid from the base of the medium pressure column and to send it to two different levels in the low pressure column, located below the impure nitrogen withdrawal level.

The principal drawback of "Oxytonne" (trademark of L'Air Liquide) with a pump results from the excess pressure of the air at its condensation pressure. If the oxygen must be pumped to consequent pressures such that it is necessary to excessively compress the air to a pressure higher than that of the medium pressure column, this invention is of no interest because overall there is a greater expenditure of compression energy with this arrangement, given that the flow rate of excessively compressed air is approximately three times greater than that of the system according to EP-A-422.974, if all the unexpanded air passes to the auxiliary exchanger.

If the reflux at the head of the low pressure column is low, when it is desired to separate argon according to a conventional distillation method in a column in parallel with the low pressure column, this gives rise to a poor argon recovery.

This reduction of the head reflux can be due to several factors:

If air is condensed in an oxygen vaporizer and does not take part in distillation in the medium pressure column and therefore does not participate in the heating in the principal vaporizer in the base of the low pressure column. Thus, the quantity of liquid nitrogen for reflux at the head of the low pressure column is reduced.

The same is true if work expanded air is sent only to the low pressure column, further reducing the head reflux of the low pressure column.

To overcome these difficulties, there was proposed in EP-A-422,974 to send a portion of the condensed air into the medium pressure column, several plates above the bottom, so that it can take part at least somewhat in the distillation in this column.

However, in the present invention, to compensate the reflux losses due for example to the fact that the liquid phase of the air condensed in the external vaporizer joins the rich liquid in the base of the medium pressure column, this rich liquid is divided into two fractions:

a first fraction is sent to the low pressure column at a first level, normally the level of blowing in air in the case in which there is a blowing turbine;

a second fraction is sent to the low pressure column at a level intermediate between the first level and the level of withdrawal of impure nitrogen.

It is clear that this arrangement of the injection levels can be of interest for the processes for cryogenic distribution other than the one described in the present application.

Figure 2:
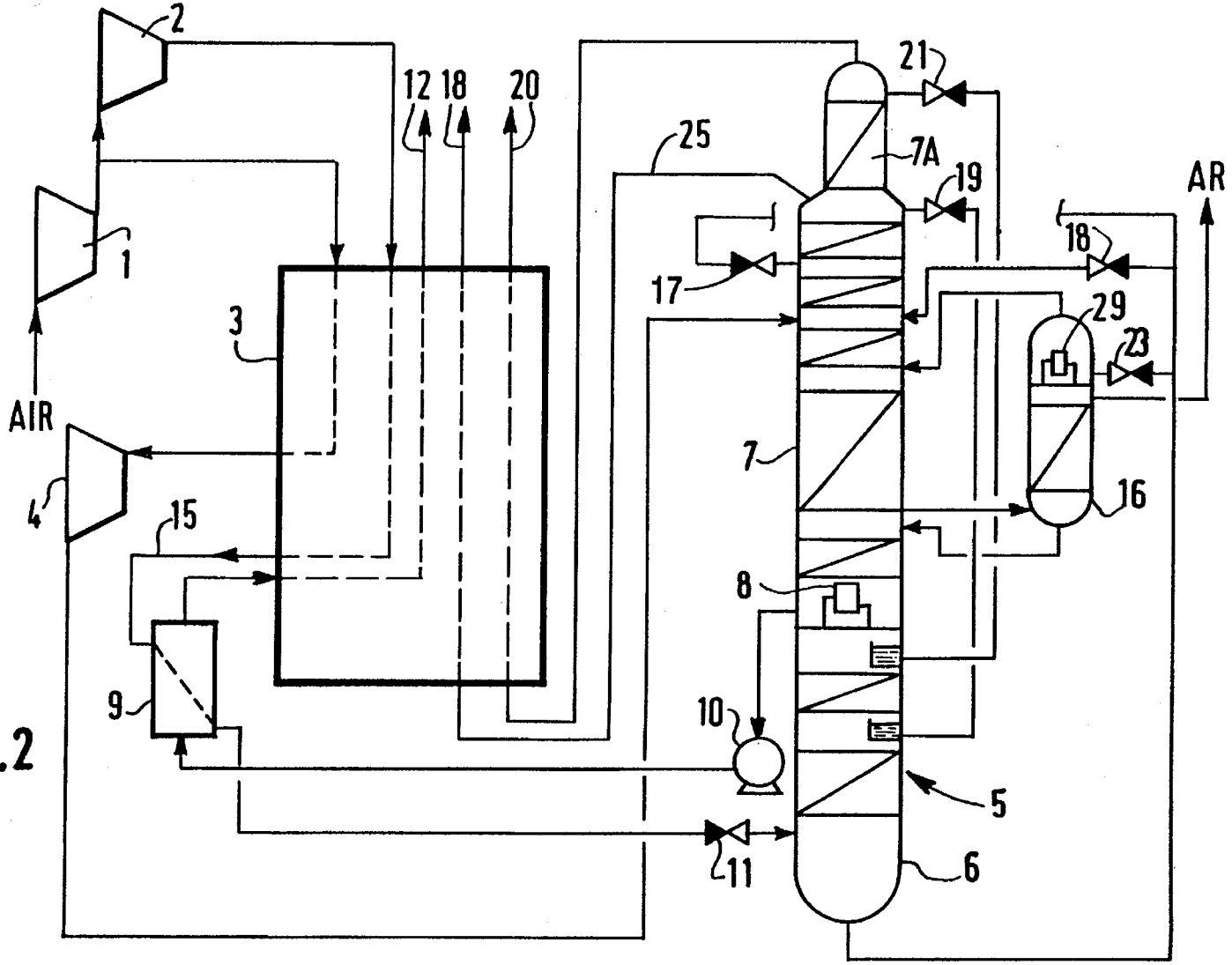
Figure 3:
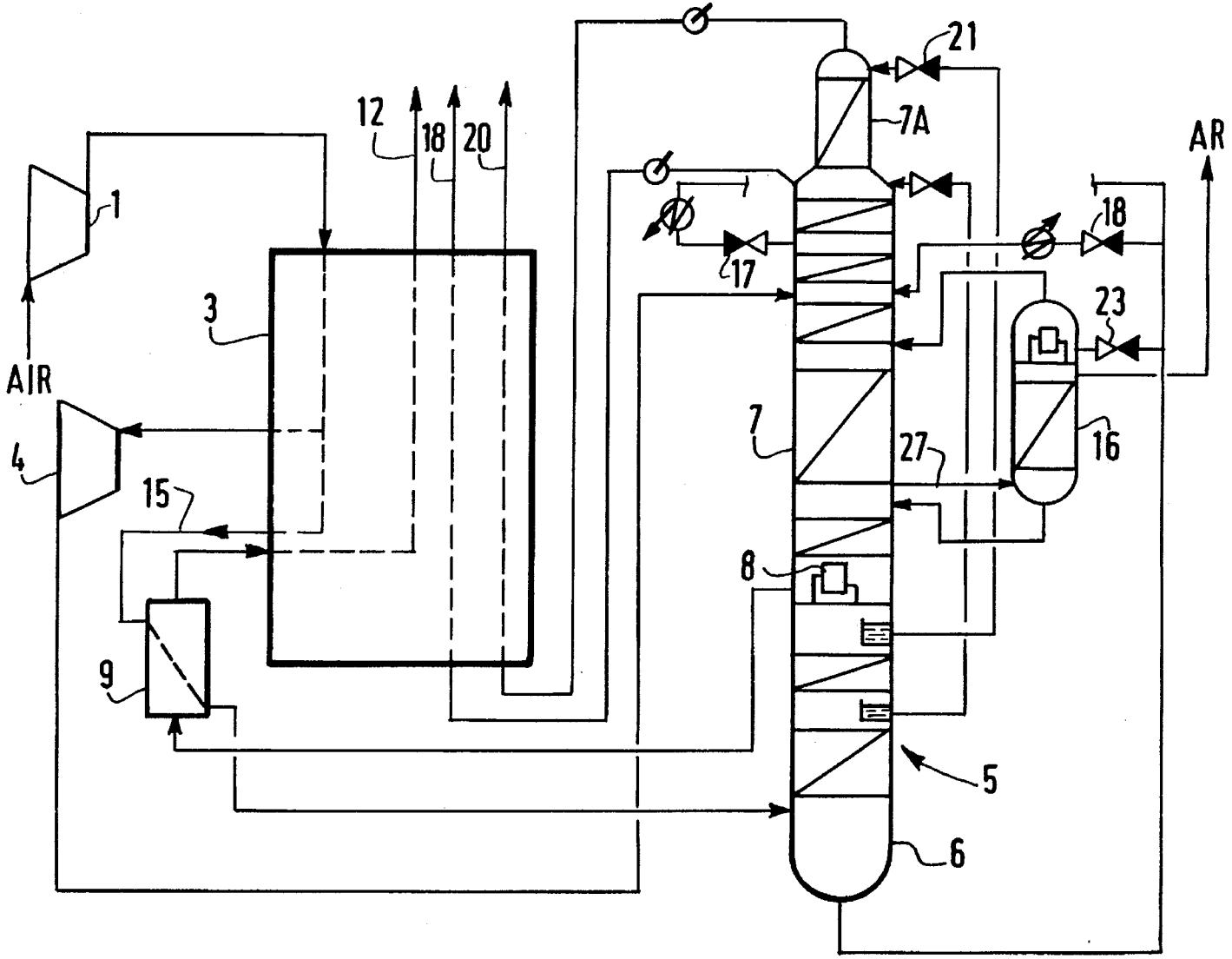

Examples of operation of the invention and of the prior art will now be described with respect to the accompanying drawings, in which:

FIG. 1 shows schematically an embodiment of installation according to the prior art; and FIGS. 2 and 3 show schematically two embodiments of the installation according to the invention.

The installation shown in FIG. 1 comprises essentially a principal air compressor 1 with variable flow rate, for example of the centrifugal type with mobile blades, an air supercharger 2 with mobile blades, a heat exchange line 3, a cold supply turbine 4, an apparatus 5 for the distillation of air comprised by a double column comprising itself a medium pressure column 6 surmounted by a low pressure column 7 and a minaret 7A, a vaporizer-condenser 8, an auxiliary heat exchanger 9 and a pump 10. This installation is adapted to produce a variable flow rate of gaseous oxygen via a conduit 12, under a pressure greater than atmospheric pressure.

The nominal flow rate of air to be treated, compressed to 6 bar by the compressor 1, cooled to ambient temperature and purified, is divided into two fractions. The first fraction is supercharged by the supercharger 2 and the second fraction passes directly to the heat exchange line 3 in which it is divided into two streams each having a constant flow rate:

a first stream is cooled in passages of the heat exchange line; one portion leaves this heat exchange line after partial cooling, is expanded to 1 bar in the turbine 4 and blown into the low pressure column 7 in the vicinity of its dew point; a second flow continues its cooling to the vicinity of its dew point under 6 bars, then is injected into the base of the low pressure column 6 via a conduit 14.

The first supercharged fraction is cooled to the vicinity of its dew point in passages of the heat exchange line, then condensed in auxiliary exchanger 9 and is divided into a first constant flow expanded to 6 bars sent to the medium pressure column via a conduit 16, and a second constant flow rate expanded to 1 bar in an expansion valve 13 then injected into the low pressure column 7.

The vaporizer-condenser 8 vaporizes a constant flow rate of liquid oxygen in the base of the low pressure column by condensation of an approximately equal flow rate of nitrogen at the head of the medium pressure column. "Rich liquid" (air enriched in oxygen) removed from the base of the medium pressure column is expanded to 1 bar in an expansion valve 18 and is injected at an intermediate level of the low pressure column, and "poor liquid" (nearly pure nitrogen) removed from the head of the medium pressure column and expanded to 1 bar in an expansion valve 19 is injected into the head of the low pressure column.

Liquid nitrogen is injected into the top of the minaret 7A via the expansion valve 21. Pure nitrogen is withdrawn from the top of minaret 7A and sent to the heat exchange line 3 there to be reheated before leaving via conduit 20. The impure nitrogen leaves by the conduit 25 from the top of the low pressure column 7 and is evacuated via a conduit 18.

The liquid oxygen withdrawn from the base of the low pressure column 7 is pumped to the production pressure before being vaporized in the auxiliary exchanger 9 (constituted by a "film" type vaporizer) by heat exchange with the air which condenses partially therein. The vaporized oxygen leaves, after reheating in the heat exchange line 3, via the conduit 12.

To produce argon, a fraction rich in argon is withdrawn from the lower portion of the low pressure column 7 and is sent to the argon column 16 there to be distilled. This fraction comprises essentially argon and oxygen. The bottom liquid resulting from the distillation in the column 16 is returned to the lower part of the low pressure column 7. The head condenser 29 of the argon column 16 is cooled by rich liquid from the base of the medium pressure column 6, expanded by valve 23, vaporized and sent to the low pressure column.

The remaining portion of the rich liquid from the base of the medium pressure column 6 is expanded by the valve 18 to a pressure slightly above atmospheric pressure and sent to the low pressure column 7 via the valve 18, substantially at the same level as the injection level of the air expanded in the turbine 4 (blown-in air).

The installation shown in FIG. 2 differs from the prior art by the fact that all the air which is not super-charged by the supercharger 2 is sent to the turbine 4 to be expanded and sent to the low pressure column 7. The air supercharged and partially condensed in the auxiliary exchanger 9 is entirely injected into the base of the medium pressure column 6.

To improve the argon output, the remaining portion of the rich liquid not vaporized in 29 is divided into two fractions: a first fraction is injected, as shown in FIG. 1, after expansion in the valve 18 into the low pressure column 7 at the level of the blown-in air and the second fraction of rich liquid is sent to the low pressure column 7, after expanding to the pressure of this latter in the valve 17, at an intermediate level between the level of injection of the first fraction of rich liquid from the valve 18 and the level of withdrawal of nitrogen via the conduit 25.

In the case in which the liquid oxygen is pressurized to a pressure concomitant to the pressure of the medium pressure column (that is to say to about 2 bars), the system of FIG. 2 can be simplified.

The modification of FIG. 3 comprises but a single air compressor 1, all the compressed air being sent either to the turbine 4 or to the exchanger 9. The air partially condensed in the exchanger 9 passes entirely to the base of the medium pressure column 6. The difference in level between the liquid oxygen level in the base of the low pressure column and its inlet into the vaporizer 9 fixes, in this case, the vaporization pressure of the oxygen; the pump 10 of FIG. 2 is thus omitted.

If needed, the fractions of rich liquid can be subcooled so that the temperature of the fraction injected at the level of blowing in the air will be less than that of the fraction injected at the intermediate level.

This arrangement of the exchanger 9 permits a gain of about 6% as to air compression and hence as to specific energy for the oxygen product.

This arrangement of the injection levels of the rich liquid permits obtaining a gain in argon production of about 5%, in comparison with that of EP-A-422.974. The output obtained with the process of the present invention is about 80%.

We claim:

1. A process for the production of gaseous oxygen under pressure by cryogenic distillation of air in a double column comprising a medium pressure column and a low pressure column, comprising dividing rich liquid from the medium pressure column into first and second liquid fractions, sending all of said first and second liquid fractions in liquid phase to different levels in the low pressure column, and withdrawing impure nitrogen from the low pressure column, both of said different levels being below a level of said withdrawal of impure nitrogen from the low pressure column.

2. Process according to claim 1, in which a fluid enriched in argon is withdrawn from the low pressure column and distilled in an argon column.

3. Process according to claim 1, in which liquid enriched in oxygen is withdrawn from a lower portion of the low pressure column.

4. Process according to claim 1, in which the two said fractions are cooled to different temperatures before being sent to the low pressure column.

5. Process according to claim 1, in which a portion of the supply air is blown into an intermediate level of the low pressure column and the levels of injection of the rich liquid are not below this intermediate level.

6. Installation for the production of gaseous oxygen under pressure by cryogenic distillation of air comprising a double column, constituted by at least one medium pressure column surmounted by a low pressure column, means to withdraw impure nitrogen from the low pressure column, means to withdraw rich liquid from the base of the medium pressure column, means to divide rich liquid withdrawn from the base of the medium pressure column into two liquid streams, and means to send all of both said liquid streams to two different levels of the low pressure column in liquid phase, both said levels being located below the level of withdrawal of said impure nitrogen.

7. Installation according to claim 6, further comprising an argon distillation column supplied from said low pressure column.

8. Installation according to claim 6, further comprising means to withdraw a liquid enriched in oxygen from a lower portion of the low pressure column.

9. Installation according to claim 6, further comprising means to send said rich liquid into the low pressure column at two different temperatures.

10. Installation according to claim 6, further comprising means to send the air to an intermediate level of the low pressure column, and means to send the two fractions of rich liquid to levels at least as high as said intermediate level.

* * * * *